US005616018A

United States Patent [19]

Ma

[11] Patent Number: 5,616,018

[45] Date of Patent: Apr. 1, 1997

[54] OIL SUPPLYING APPARATUS FOR A HORIZONTAL TYPE ROTARY COMPRESSOR

[75] Inventor: Young C. Ma, Kyungki-Do, Rep. of Korea

[73] Assignee: Goldstar Co., Ltd., Rep. of Korea

[21] Appl. No.: 641,086

[22] Filed: Apr. 29, 1996

Related U.S. Application Data

[63] Continuation of Ser. No. 347,711, Dec. 1, 1994, abandoned.

[30] Foreign Application Priority Data

Dec. 3, 1993 [KR] Rep. of Korea ..... 26393

[51] Int. Cl.[6] ..... F04C 18/356; F04C 29/02

[52] U.S. Cl. ..... 418/63; 418/88; 418/94; 418/96; 184/6.16

[58] Field of Search ..... 418/63, 88, 94, 418/96; 184/6.16

[56] References Cited

U.S. PATENT DOCUMENTS

| | | | |
|---|---|---|---|
| 4,472,121 | 9/1984 | Tanaka et al. | 418/94 |
| 4,561,829 | 12/1985 | Iwata et al. | 418/63 |
| 4,568,256 | 2/1986 | Blain | 418/94 |
| 4,645,429 | 2/1987 | Asami et al. | 418/94 |
| 4,781,542 | 11/1988 | Ozu et al. | 184/6.16 |
| 5,012,896 | 5/1991 | Da Costa | 184/6.16 |
| 5,098,266 | 3/1992 | Takimoto et al. | 418/63 |

FOREIGN PATENT DOCUMENTS

| | | | |
|---|---|---|---|
| 2110940 | 10/1971 | German Dem. Rep. | 418/94 |
| 58-174176 | 10/1983 | Japan | 418/94 |
| 61-79888 | 4/1986 | Japan | 418/63 |
| 62-147081 | 7/1987 | Japan | 418/94 |
| 1-301987 | 12/1989 | Japan | 418/96 |
| 5195970 | 8/1993 | Japan | 418/94 |

*Primary Examiner*—John J. Vrablik
*Attorney, Agent, or Firm*—Ostrolenk, Faber, Gerb & Soffen, LLP

[57] ABSTRACT

An oil supplying apparatus for a horizontal type rotary compressor capable of securing a substantial oil supplying and preventing oil leakage to the outside thereof thereby enhancing higher oil supplying efficiency of the compressor is disclosed. The present invention includes a body of a horizontal type rotary compressor; a rotary shaft including an oil path and an eccentric rotary shaft; and a crank shaft passing through a main bearing, in which the outer entire circumferential surface thereof is sealingly fixedly affixed to the entire inner circumferential surface of the body, including a refrigerant guide opening, formed at a predetermined portion of the circumferential surface thereof, having a predetermined diameter for guiding the compressed refrigerant therethrough, a bolt opening formed below the refrigerant guiding opening having a predetermined diameter, a rotary shaft opening formed at the center portion thereof having a predetermined diameter, an injection portion formed below the rotary shaft opening for injecting the compressed refrigerant therethrough, and an oil opening formed below the injection portion for passing the oil therethrough.

3 Claims, 4 Drawing Sheets

OIL SUPPLYING APPARATUS FOR A HORIZONTAL TYPE ROTARY COMPRESSOR

This is a continuation of application Ser. No. 08/347,711, filed on Dec. 1, 1994, abandoned.

BACKGROUND OF THE INVENTION

1. Field of the Invention

The present invention relates to an oil supplying apparatus for a horizontal type rotary compressor, and in particular to an oil supplying apparatus for a horizontal type rotary compressor, usually used in a freezing and/or a refrigerating machine, capable of assuming substantial oil supply to the compressor and preventing oil leakage to the outside thereof, thereby enhancing the oil supply efficiency of the compressor.

2. Description of the Conventional Art

Referring to FIG. 1 and FIG. 2, a conventional oil supplying apparatus of a horizontal type rotary compressor is shown.

As shown therein, an outer circumferential surface of a hollow cylindrical stator 11 is fixedly disposed at a predetermined portion inside the cylindrical body 10. A rotor 12 rotatably electrically cooperating with the stator 11 is disposed inside the stator 11. Here, there is formed a gap between the inner circumferential surface of the stator 11 and the outer circumferential surface of the rotor 12. A shaft 13 is fixedly integrally inserted into the rotor 12. An oil path 14 having a predetermined depth and diameter is formed inside the shaft 13. A plurality of oil supplying openings 14' are formed at the circumferential surface of the oil path 14.

Meanwhile, a shaft 13 passes through a main bearing 15. A sub-bearing 16 is rotatably inserted onto the shaft 13 while maintaining a predetermined distance with the main bearing 15. An eccentric shaft 17 integrally formed with the shaft 13 and having a different center of rotation against the shaft 13 is disposed between the main bearing 15 and the sub-bearing 16. A roller 18 having a predetermined thickness is evenly formed around the outer circumferential surface of the eccentric shaft 17. An internal circumferential surface of the cylinder 19 is formed outside the roller 18. Here, the outer circumferential surface of the roller 18 travels along the internal circumferential surface of the cylinder 19. The center of the cylinder 19 is eccentrically formed against the center of rotation of the roller 18. Meanwhile, the outer circumferential surface of the cylinder 19 is fixedly affixed to the inner circumferential surface of the body 10 while maintaining a predetermined air gap therebetween. A bolt 20 is disposed in order to secure the main bearing 15, the sub-bearing 16 and the cylinder 19. Here, since the internal center of the cylinder 19 corresponds to the center of the shaft 13 and the rotation center of the eccentric crank shaft 17 is eccentrically formed against the shaft 13, as the shaft 13 rotates, the roller 18 eccentrically travels along the inner circumferential surface of the cylinder 19. Accordingly, as the roller 18 rotates, a predetermined space is generated inside the cylinder 19. Meanwhile, a vane groove 21 is formed at a predetermined portion of the cylinder 19. A vane 22 is slidably inserted into the vane groove 21. Here, when the eccentric crank shaft 17 is positioned at the top dead point inside the cylinder 19, there is defined a suction chamber 23 at right space which is defined by the outer circumference of the roller 18 and the vane 22 and there is defined a compression chamber 24 at the opposite portion thereof. The volume of both the suction chamber 23 and the compression chamber 24 vary as the roller 18 rotates along the inner circumferential surface of the cylinder 19. Meanwhile, a spring 25 is disposed under the vane 22 inside the vane groove 21 in order to elastically support the vane 22.

Meanwhile, an injection opening 26 is formed in the suction chamber 23 in order to guide the refrigerant therethrough. An exhaust opening 27 is formed in the compression chamber 23 in order to guide the compressed refrigerant therethrough. A reed valve (not shown) is disposed at the entrance portion of the exhaust opening 27, which is forcibly opened by the compressed refrigerant. Here, the outer circumferential surface of the cylinder 19 is affixed to the inner circumferential surface of the body 10. Here, the exhaust opening 27 is extended to a first refrigerant chamber G1 through the main bearing 15. One end of an oil supplying pipe 29 is connected to a predetermined portion of the wall of the vane groove 21. Here, a liquid diode 28 is disposed at one end thereof and the other end thereof is connected to an oil path 14. An oil opening 31 having a liquid diode 30 at one end thereof is formed at a predetermined portion of the wall of the vane groove 21. The oil 60 provided at the bottom portion of the body 10 is supplied to the vane groove 21 through the oil opening 31.

In the drawings, reference numeral 40 denotes a power supplying section in order to supply power to the motor consisting of the stator 11 and the rotor 12. Reference numeral 50 denotes an exhaust pipe for exhausting the compressed refrigerant therethrough. Reference numeral 60 denotes oil.

The operation of the conventional horizontal type rotary compressor will now be explained.

To begin with, oil 60 is provided at the bottom portion of the body 10 at a predetermined level. When the power is supplied to the stator 11, the rotor 12 rotates in cooperation with the stator 11. As the rotor 12 rotates, the eccentric crank shaft 17 rotates in cooperation with the stator 11. When the eccentric crank shaft 17 is positioned at the bottom dead point inside the cylinder 19, the outer circumferential surface of the roller 18 is in slide contact with the top portion of the vane 22. At this time, the spring 25 is compressed thereby. As in the aforementioned state, the roller 18 rotates by about 24° in counterclockwise direction, the pressure in the suction chamber 23 is lowered and at the same time the refrigerant is sucked through the injection opening 26. When the roller 18 is placed at the top dead point, the suction chamber 23 is filled with the refrigerant. When the roller 18 is positioned at the bottom dead point, the upper portion of the roller 18 is filled with the refrigerant in maximum. At this time, when the roller 18 begins to rotate in counterclockwise direction, the refrigerant in the compression chamber 24 is compressed by the rotation force of the roller 18. When the refrigerant in the compression chamber 24 is compressed at a predetermined level, the reed valve(not shown) is forcibly opened and the refrigerant is exhausted to the first refrigerant chamber G1 therethrough.

Meanwhile, much friction heat is generated between the outer circumferential surface of the shaft 13 and the inner circumferential surface of the main bearing 15 and the sub-bearing 16. In an attempt to reduce the friction resistance therebetween, the oil 60 is supplied thereto.

The oil operation will now be explained.

To begin with, oil 60 is supplied at the bottom portion inside the body 10. Here, the oil 60 freely moves between the first refrigerant chamber G1 and the second refrigerant chamber G2 because the outer circumferential surface of the cylinder 19 is not sealingly affixed to the inner circumferential surface of the body. The oil 60 flows to the vane groove 21 through the oil path 31. Meanwhile, as the roller 18 rotates eccentrically, the vane 22 moves vertically along the vane groove 21. When the eccentric crank shaft 17 is placed at the bottom dead point, the vane 22 is placed at the lowest portion and the oil 60 in the vane groove 21 is compressed and forcibly enters the oil supplying pipe 29. Meanwhile, the eccentric crank shaft 17 is placed at the top dead point, the vane is placed at the maximum upper portion and the oil 60 is sucked from the oil path 31. Here, the liquid diodes 28 and 30 are each disposed at the oil supplying pipe 29 and the oil opening 31 in order to prevent the backward flowing of the oil 60.

However, when the volume of the vane groove 21 increases, that is, the eccentric crank shaft 17 rotates toward the top dead point, a backward flow of the oil might occur at the liquid diode 28 and on the contrary, when the volume of the vane groove decreases, that is, the eccentric crank shaft 17 rotates toward the bottom dead point, backward flowing of oil 60 might occur at the liquid diode 30, thereby causing insufficient oil supply whereby friction induced heat-damage might occur.

SUMMARY OF THE INVENTION

Accordingly, it is an object of the invention to provide an oil supplying apparatus for a horizontal type rotary compressor, usually used in a freezing and/or a refrigerating machine, capable of securing substantial oil supply and preventing oil leakage to the outside thereof thereby enhancing higher oil supplying efficiency of the compressor.

To achieve the object, the present invention includes a body of a horizontal type rotary compressor; a crank shaft including an oil path and art eccentric crank shaft; and a main bearing, rotatably inserted onto the crank shaft, in which the outer entire circumferential surface thereof is sealingly fixedly affixed to the entire inner circumferential surface of the body, including a refrigerant guide opening, formed at a predetermined portion of the circumferential surface thereof, having a predetermined diameter for guiding the compressed refrigerant therethrough, a bolt opening formed below the refrigerant guiding opening having a predetermined diameter, a crank shaft opening formed at the center portion thereof having a predetermined diameter, an injection portion formed below the crank shaft opening for injecting the compressed refrigerant therethrough, and an oil opening formed below the injection portion for passing the oil therethrough.

To achieve another object of the present invention, it includes a body of a horizontal type crank compressor; a rotary shaft including an oil path and an eccentric crank shaft; a shaft passes through a main bearing; an eccentric crank shaft having the different rotating center against the shaft; and a sub-bearing inserted onto the crank shaft, in which the outer entire circumferential surface thereof is sealingly fixedly affixed to the entire inner circumferential surface of the body, including a refrigerant guide opening, formed at a predetermined portion of the circumferential surface thereof, a bolt opening formed below the refrigerant guiding opening having a predetermined diameter, a crank shaft opening formed at the center portion thereof having a predetermined diameter, an oil opening formed below the crank shaft opening for guiding the compressed refrigerant therethrough.

DETAILED DESCRIPTION OF THE PREFERRED EMBODIMENTS

Figure 1:
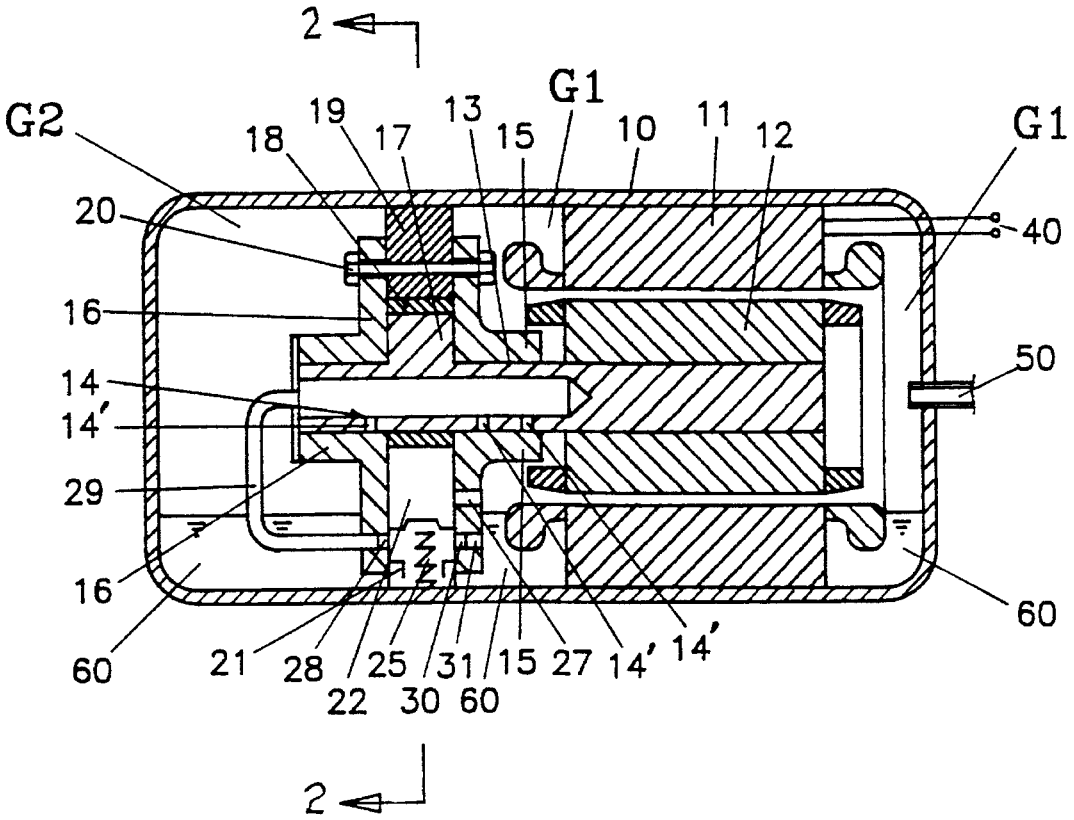
Fig. 1 CONVENTIONAL ART
FIG. 1 is a cross-sectional view showing a structure of a conventional horizontal type rotary compressor.
Figure 2:
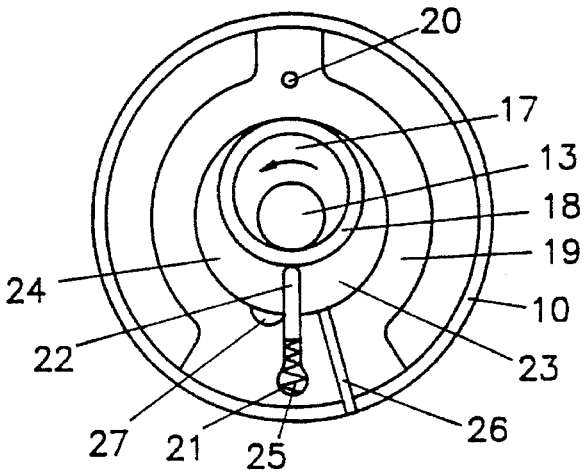
Fig. 2 CONVENTIONAL ART
FIG. 2 is a cross-sectional view taken along a line 2—2 of FIG. 1.
Figure 3:
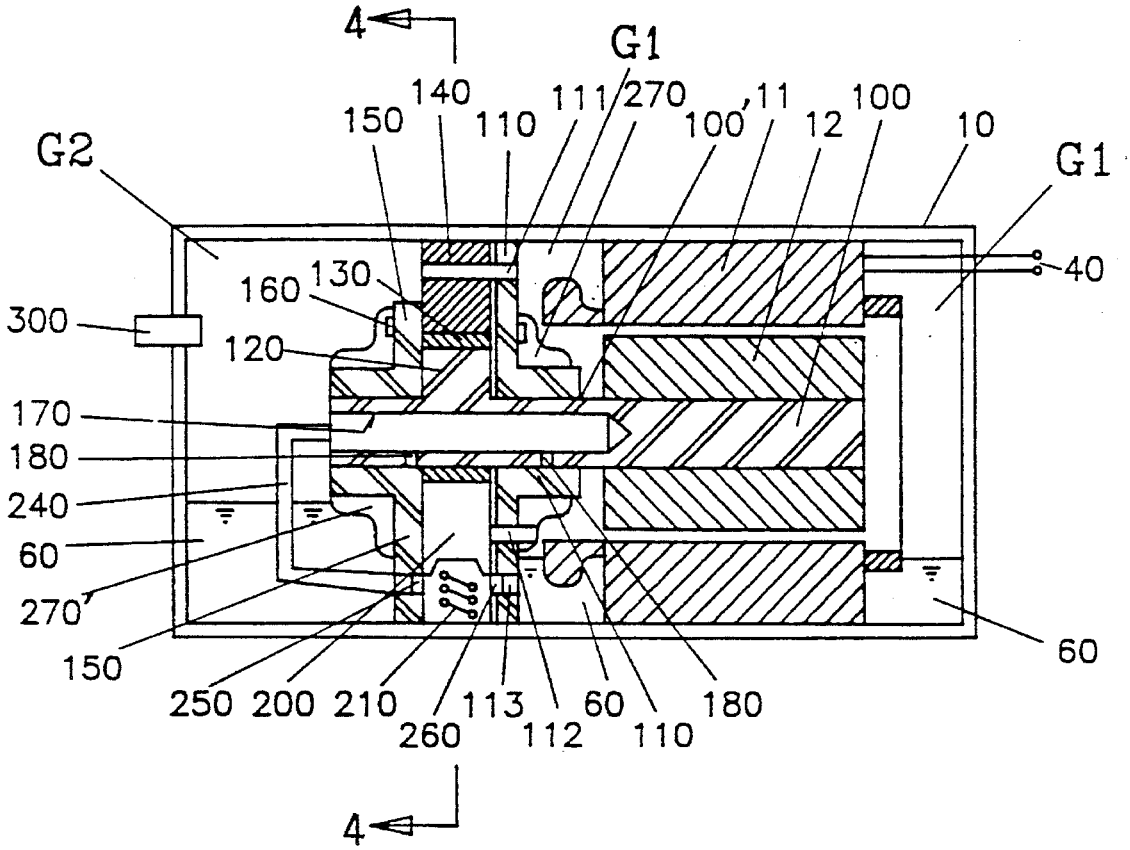
FIG. 3 is a cross-sectional view showing a structure of a horizontal type rotary compressor according to a first embodiment of the present invention.
Figure 4:
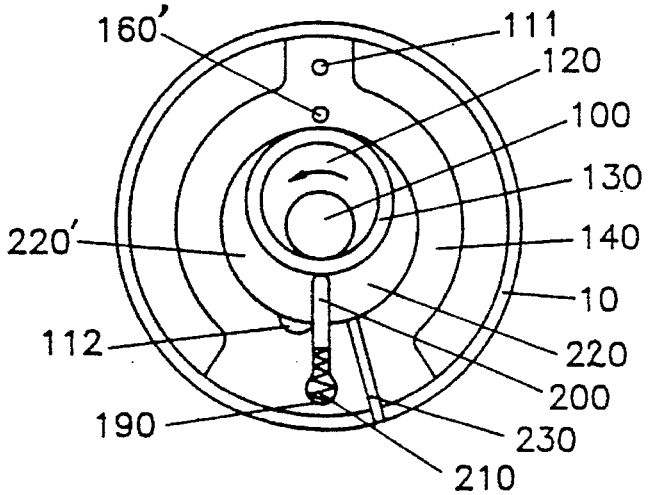
FIG. 4 is a cross-sectional view taken along a line 4—4 of FIG. 3.
Figure 5:
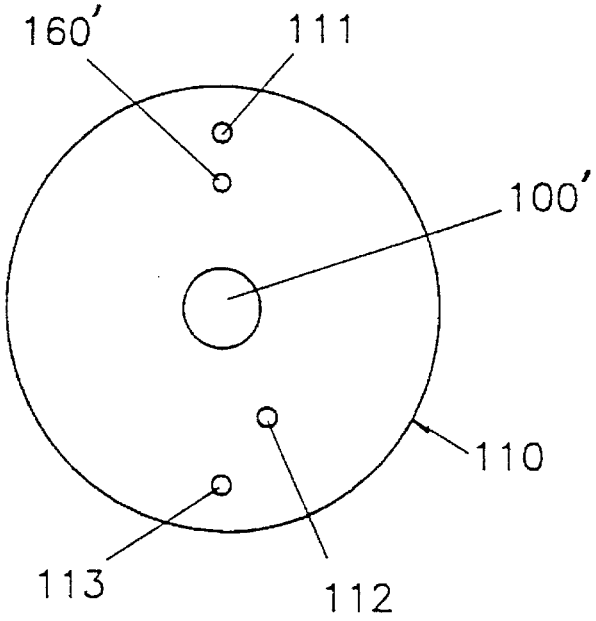
FIG. 5 is a bottom view showing a main bearing of a horizontal type rotary compressor according to the present invention.

Referring to FIG. 3 to 5, the structure of a first embodiment according to the present invention will now be explained.

The same reference numerals given to the elements of the conventional art are also used in the present invention.

To begin with, an outer circumferential surface of a hollow cylindrical stator 11 is fixedly disposed at a predetermined portion inside the cylindrical body 10. A rotor 12 rotatably electrically cooperating with the stator 11 is disposed inside the stator 11. Here, there are formed a gap between the inner circumferential surface of the stator 11 and the outer circumferential surface of the rotor 12. A shaft 100 is fixedly integrally inserted into the rotor 12.

Meanwhile, a circular main bearing 110 is inserted over the shaft 100. Here, the outer circumferential surface of the main bearing 110 is sealingly affixed to the inner circumferential surfaces of the body 10. A refrigerant guide opening 111 is formed at a predetermined upper portion thereof in order to guide the refrigerant therethrough. A bolt opening 160' is formed below the refrigerant guide opening 111. A shaft opening 100' is formed at the central portion thereof. An exhaust opening 112 is formed below the shaft opening 100' in order to exhaust the compressed refrigerant therethrough. An oil opening 113 is formed below the exhaust opening 112 in order to guide the oil 60 therethrough.

Meanwhile, an eccentric crank shaft 120 is disposed in front of the main bearing 110. A roller 130 having a predetermined thickness is formed around the outer circumferential surface of the eccentric shaft 120. An internal circumferential surface of the cylinder 140 is evenly formed outside the roller 130. Here, the outer circumferential surface of the roller 130 travels along the internal circumferential surface of the cylinder 140. In addition, the center of the cylinder 140 is eccentrically formed against the rotation center of the roller 130. The refrigerant guiding opening 111 is formed at a predetermined portion of the cylinder 140 in order to guide the refrigerant therethrough. The eccentric crank shaft 120 is a part of the rotary shaft. Here, a bolt 20 is disposed in order to secure the main bearing 15, the sub-bearing 16 and the cylinder 19. Meanwhile, an oil path 170 having a predetermined depth and diameter is formed inside the shaft 100. A plurality of oil supplying openings 180 are formed at the circumferential surface of the oil path 170. The oil 60 is supplied to the friction surface between the outer surface of the shaft 100 and the inner surface of the main bearing 110 and the sub-beating 150 through the plurality of the oil supplying openings 180.

Meanwhile, a vane groove 190 is formed at a predetermined portion of the cylinder 140. A vane 200 is slidably inserted into the vane groove 190. Here, when the eccentric crank shaft 120 is positioned at the top dead point inside the cylinder 140, there is defined a suction chamber 220 at a space which is defined by the outer circumference of the roller 130 and the right-hand side of the vane 200 and there is defined a compression chamber 220' at the opposite portion. The volume of both the suction chamber 220 and the compression chamber 220' vary as the roller 130 rotates along the inner circumferential surface of the cylinder 140. Meanwhile, a spring 190 is disposed under the vane 200 inside the vane groove 190 in order to elastically support the vane 200.

In addition, an injection opening 230 is formed in the suction chamber 220 in order to guide the refrigerant therethrough. An exhaust opening 112 is formed in the compression chamber 220' in order to guide the compressed refrigerant therethrough. A reed valve(not shown) is disposed at the entrance portion of the exhaust opening 112, which is forcibly opened by the compressed refrigerant. Here, the exhaust opening 112 is extended to the first refrigerant chamber G1 (explained hereinafter) through the main bearing 110. One end of an oil supplying pipe 240 is connected to a predetermined portion of the wall of the vane groove 190. Here, a liquid diode 250 is disposed at one end thereof and the other end thereof is connected to the oil path 170. An oil opening 113 having a liquid diode 260 at one end thereof is formed at a predetermined portion of the wall of the vane groove 190. The oil 60 provided at the bottom portion of the body 10 flows into the vane groove 190 through the oil opening 113. Here, since the outer circumferential surfaces of the main bearing 110 and the cylinder 140 are sealingly affixed to the inner circumferential surface of the body 10, there are defined a first refrigerant chamber G1 and a second refrigerant chamber G2 inside the body 10.

In the drawings, reference numeral 40 denotes a power supplying section in order to supply power to the motor consisting of the stator 11 and the rotor 12. Reference numeral 300 denotes an exhaust pipe for exhausting the compressed refrigerant therethrough. Reference numeral 60 denotes oil.

Referring to FIGS. 3 to 5, the operation of the first embodiment according to the present invention will now be explained.

To begin with, the oil 60 is provided at the bottom portion of the body 10 at a predetermined level. When the power is supplied to the stator 11, the rotor 12 rotates in cooperation with the stator 11. As the rotor 12 rotates, the eccentric crank shaft 120 rotates in cooperation with the stator 11. When the eccentric crank shaft 120 is positioned at the bottom dead point, the outer circumferential surface of the roller 130 is in slide contact with the top portion of the vane 200. At this time, the spring 210 is compressed thereby. As mentioned before, the roller 130 rotates by about 24° in counterclockwise direction, the pressure of the suction chamber 220 is lowered and at the same time the refrigerant is sucked through the injection opening 230. When the roller 130 is placed at the top dead point, the suction chamber 220 is filled with the refrigerant. When the roller 130 is positioned at the bottom dead point, the upper portion of the roller 130 is filled to capacity with the refrigerant. At this time, when the roller 130 begins to rotate, the refrigerant in the compression chamber 220' is compressed by the rotation force of the roller 130. When the refrigerant in the compression chamber 220' is compressed at a predetermined level, the reed valve(not shown) is forcibly opened and the refrigerant is exhausted to the first refrigerant chamber G1 therethrough. Here, the refrigerant in the first refrigerant chamber G1 has a predetermined level of compression which is higher than the compression level in the second refrigerant chamber G2 since pressure is lost by the refrigerant in passing from first refrigerant chamber G1 through refrigerant guide opening 111 into second refrigerant chamber G2, so that the oil 60 in the first refrigerant chamber G1 is compressed due to the higher refrigerant pressure and thus the oil 60 effectively and advantageously flows into the vane groove 190 through the oil opening 113. The oil sucked into the vane groove 190 is compressed when the roller 130 is positioned at the bottom dead point.

Thereafter, the refrigerant in the first refrigerant chamber G1 flows into the second refrigerant chamber G2 through the refrigerant guiding opening 111. The refrigerant in the second refrigerant chamber G2 flows to the outside through the exhaust pipe 300.

Figure 6:
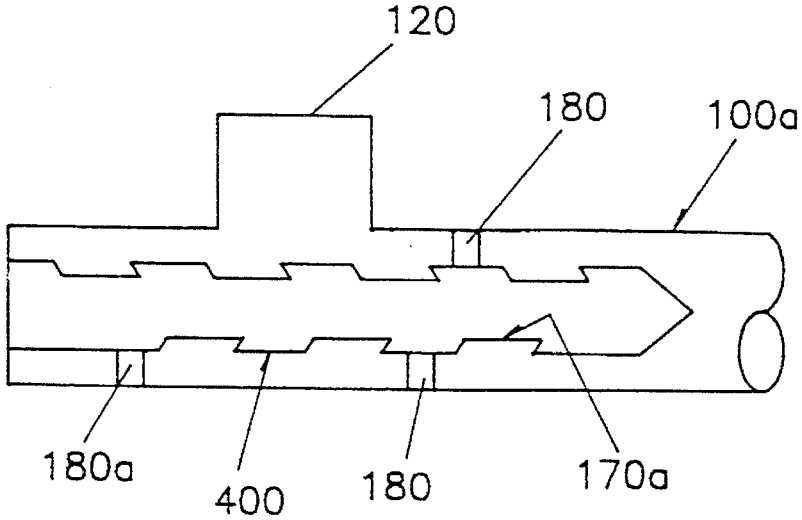
FIG. 6 is a cross-sectional view showing an eccentric crank shaft of a second embodiment according to the present invention.

Referring to FIG. 6, there are shown a second embodiment of the present invention.

As shown therein, the invention includes an oil path 170*a* having a threaded portion 400 in which a plurality of oil supplying openings 180*a* are formed, so that the oil 60 is effectively and advantageously supplied to the friction surface thereof because the oil 60 travels evenly along the threaded portion.

Figure 7:
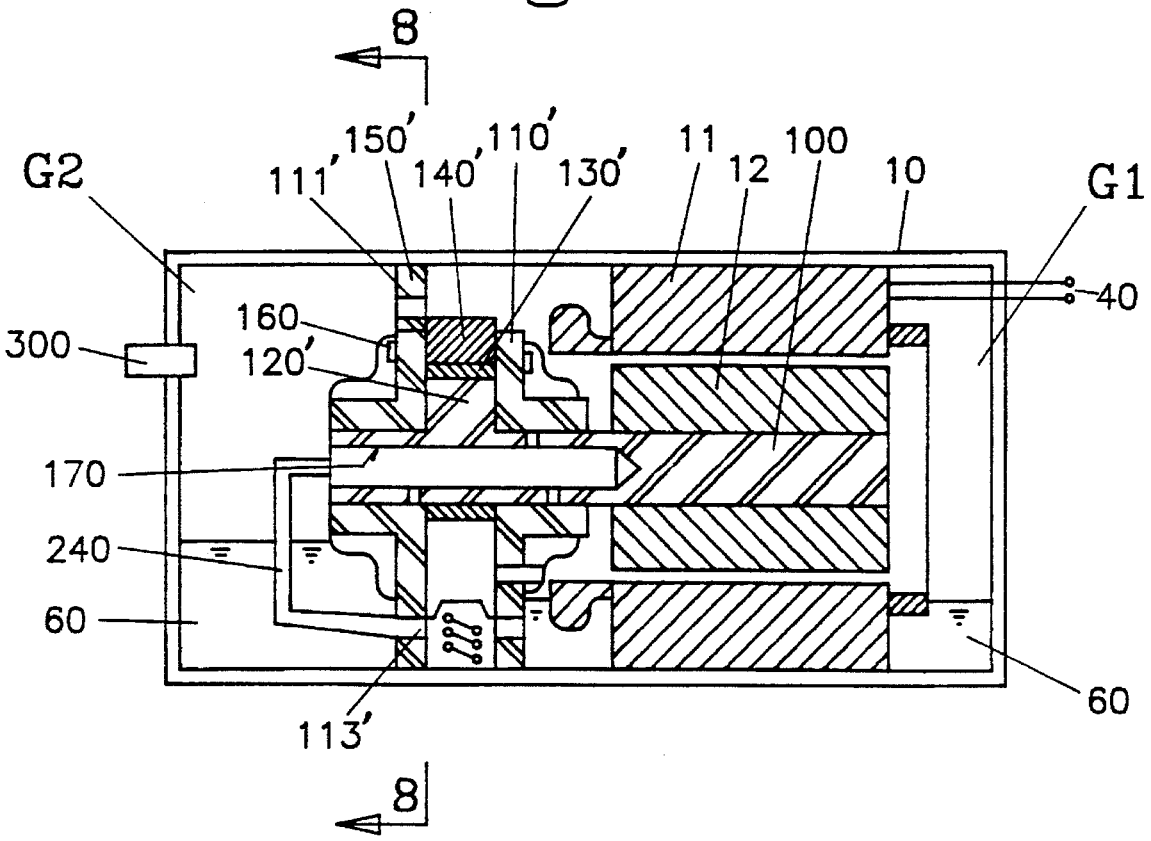
FIG. 7 is a cross-sectional view showing a structure of a horizontal type rotary compressor according to a third embodiment of the present invention.
Figure 8:
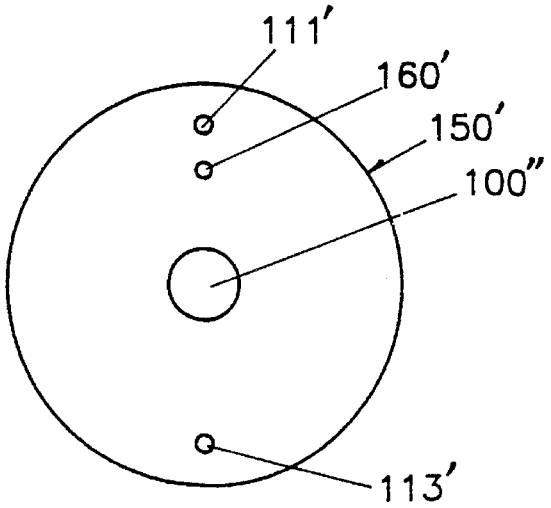
FIG. 8 is a bottom view showing a sub bearing of a horizontal type rotary compressor according to the present invention.

Referring to FIGS. 7 and 8, there are shown a third embodiment of the present invention.

The same reference numerals given to the elements of the conventional art and the first embodiment is used in the second embodiment.

To begin with, the structure thereof will now be explained. An outer circumferential surface of a hollow cylindrical stator 11 is fixedly disposed at a predetermined portion inside the cylindrical body 10. A rotor 12 rotatably electrically cooperating with the stator 11 is disposed inside the stator 11. Here, there is formed a gap between the inner circumferential surface of the stator 11 and the outer circumferential surface of the rotor 12. A shaft 100 is fixedly integrally inserted into the rotor 12.

Meanwhile, a main bearing 110' is rotatably inserted to the shaft 100. A bolt opening 160' is formed at a predetermined portion thereof. A shaft opening 100" is formed at the central portion thereof. An eccentric crank shaft 120 is disposed in front of the main bearing 110'. A roller 130' having a predetermined thickness is formed around the outer circumferential surface of the eccentric shaft 120'. An internal circumferential surface of the cylinder 140' is formed outside the roller 130'. Here, the outer circumferential surface of the roller 130' travels along the internal circumferential surface of the cylinder 140'. In addition, the center of the cylinder 140' is eccentrically formed against the rotation center of the roller 130'. A sub-beating 150' is inserted onto the shaft 100. The outer circumferential surface of the sub-bearing 150' is sealingly affixed to the inner circumferential surface of the body 10. A refrigerant guide opening 111' is formed at a predetermined portion thereof. A bolt opening 160" is formed below the refrigerant guide opening 111'. A shaft opening 100" is formed at the center portion thereof for rotatably receiving the shaft 100. Here, the main bearing 110' and the cylinder 140' and the sub-bearing 150' are affixed by the bolt 160' to each other.

The operation of the third embodiment according to the present invention will now be explained.

The refrigerant introduced into the first refrigerant chamber G1 flows toward the second refrigerant chamber G2 through the refrigerant guiding opening 111'. The refrigerant in the second refrigerant chamber G2 flows toward the outside refrigerating circle through the exhaust pipe 300. As described above, the oil supplying apparatus for a horizontal type rotary compressor according to the present invention is designed to increase the pressure in the right (first) chamber rather than that in the left (second) chamber by flowing the refrigerant gas which has a relatively high pressure thereinto, so that using the pressure in the right chamber better oil supply toward the liquid diode can advantageously be obtained. In addition, by providing the exhausting pipe in the left chamber, the oil contained in the exhausting refrigerant gas first flows into the right chamber in which the motor assembly is disposed. A lesser amount of oil is exhausted during the cycle of an operation of the system.

The third embodiment will advantageously be adapted for compressors of compact size by reducing the size of the main bearing 110' or the cylinder 140'.

What is claimed is:

1. A horizontal type rotary compressor comprising:

a cylindrical body and an oil reservoir defined in the cylindrical body;

a cylinder in the cylindrical body;

a crank shaft including an oil path having threaded portions with a plurality of pitches, an eccentric crank shaft disposed within the cylinder and a refrigerant suction chamber and compression chamber defined within the cylinder adjacent the eccentric crank shaft;

a circular main bearing rotatably supporting the crank shaft and fixed to said cylindrical body, the main bearing having a circumferential surface which sealingly engages an inner circumferential surface of the cylindrical body, and including a refrigerant guide opening passing through the main bearing for guiding compressed refrigerant therethrough;

an oil pump operatively associated with said eccentric crank shaft, and means forming an oil supplying passage between said oil pump and said oil path;

the main bearing having a crank shaft opening formed at a center portion of the main bearing and an oil opening formed below the crank shaft opening between said oil reservoir and said oil pump;

means forming a refrigerant injection opening for injecting refrigerant therethrough into the refrigerant suction chamber, and means forming a refrigerant exhaust opening below the crank shaft opening for exhausting compressed refrigerant from the compression chamber to said oil reservoir; whereby said compressed refrigerant assists in supplying oil from said oil reservoir to said oil pump.

2. The apparatus of claim 1, wherein an internal portion of said cylindrical body is divided into a first refrigerant chamber and a second refrigerant chamber by said main bearing, whereby when said compressed refrigerant flows into said first refrigerant chamber and then flows into said second refrigerant chamber through said guide opening, the pressure of the flowing refrigerant gas in the first refrigerant chamber is higher than in the second refrigerant chamber.

3. The apparatus of claim 2, wherein said second refrigerant chamber includes an exhaust pipe for exhausting the refrigerant gas.

* * * * *